US006268101B1

(12) United States Patent
Yacobucci et al.

(10) Patent No.: US 6,268,101 B1
(45) Date of Patent: Jul. 31, 2001

(54) WATER-RESISTANT POLYURETHANE OVERCOAT FOR IMAGING MATERIALS

(75) Inventors: Paul D. Yacobucci; Hwei-Ling Yau; Catherine A. Falkner, all of Rochester; Lan B. Thai, Penfield, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/548,514

(22) Filed: Apr. 13, 2000

(51) Int. Cl.[7] ..... G03C 11/08; G03C 1/76; G03G 7/00; G03G 8/00; G03G 13/22

(52) U.S. Cl. ..... 430/124; 430/104; 430/126; 430/350; 430/512; 430/527; 430/531; 430/432; 430/961; 347/102; 347/106

(58) Field of Search ..... 430/531, 537, 430/350, 961, 527, 512, 126, 124, 104, 432; 347/106, 102

(56) References Cited

U.S. PATENT DOCUMENTS

| | | | | |
|---|---|---|---|---|
| 5,605,750 | * | 2/1997 | Romano et al. | 428/195 |
| 5,800,969 | * | 9/1998 | Vandenabeele et al. | 430/537 |
| 5,853,926 | * | 12/1998 | Bohan et al. | 430/531 |
| 5,856,051 | | 1/1999 | Yau et al. | 430/537 |
| 6,077,648 | * | 6/2000 | Nair et al. | 430/531 |
| 6,190,843 | * | 2/2001 | Yau et al. | 430/537 |

* cited by examiner

*Primary Examiner*—Richard L. Schilling
(74) *Attorney, Agent, or Firm*—Chris P. Konkol

(57) ABSTRACT

The present invention relates to imaging elements, including photographic elements and recording media, having a protective overcoat that resists fingerprints, common stains, and spills. More particularly, the present invention provides a water permeable overcoat during image formation but that is water resistant in the final processed product. The overcoat, before formation of the image, comprises polyurethane particles in a gelatin-containing matrix. Subsequent to formation of the image, the overcoat is heat fused, resulting in the formation of a water-resistant continuous protective overcoat that provides excellent scratch and spill resistance.

10 Claims, No Drawings

WATER-RESISTANT POLYURETHANE OVERCOAT FOR IMAGING MATERIALS

FIELD OF THE INVENTION

The present invention relates to imaging elements, including photographic elements and recording media, having a protective overcoat that resists fingerprints, common stains, and spills. More particularly, the present invention provides a water permeable overcoat during image formation but that is water resistant in the final product. The overcoat, before formation of the image, comprises polyurethane particles in a gelatin-containing matrix. Subsequent to formation of the image, the overcoat is heat fused, resulting in the formation of a water-resistant continuous protective overcoat that provides excellent scratch and spill resistance to image recording materials.

BACKGROUND OF THE INVENTION

Gelatin has been used extensively in a variety of imaging elements as the binder because of its many unique and advantageous properties. For example, its property of water swellability allows processing chemistry to be carried out to form silver halide-based photographic images, and its hydrophilic nature allows gelatin to function as an ink-receiver in ink-jet recording media. However, due to this same property, imaging elements with exposed gelatin-containing materials, no matter if they are formed on transparent or reflective media, have to be handled with extreme care so as not to be in contact with any aqueous solutions that may damage the images. Accidental spillage of common household solutions such as coffee, punch, or even plain water can damage imaging elements such as ink-jet, electrophotographic, or photographic prints.

There have been attempts over the years to provide protective layers for gelatin-based photographic systems that will protect the images from damage by water or aqueous solutions. U.S. Pat. No. 2,173,480 describes a method of applying a colloidal suspension to moist film as the last step of photographic processing before drying. A number of patents describe methods of solvent coating a protective layer on the image after photographic processing is completed and are described, for example, in U.S. Pat. Nos. 2,259,009, 2,331,746, 2,798,004, 3,113,867, 3,190,197, 3,415,670 and 3,733,293. More recently, U.S. Pat. No. 5,376,434 describes a protective layer formed on a photographic print by coating and drying a latex on a gelatin-containing layer bearing an image. The latex is a resin having a glass transition temperature of from 30° C. to 70° C. Another type of protective coating involves the application of UV-polymerizable monomers and oligomers on a processed image followed by radiation exposure to form crosslinked protective layer, which is described in U.S. Pat. Nos. 4,092,173, 4,171,979, 4,333,998 and 4,426,431. A drawback for both the solvent coating method and for the radiation cure method is the health and environmental concern of those chemicals or radiation to the coating operator. Another drawback is that the photographic materials need to be coated after the processing step. Thus, the processing equipment needs to be modified and the personnel running the processing operation need to be trained to apply the protective coating.

Various lamination techniques are known and practiced in the trade. U.S. Pat. Nos. 3,397,980, 3,697,277 and 4,999,266 describe methods of laminating a polymeric sheet film, as a protective layer, on a processed image. Protective coatings that need to be applied to the image after it is formed, several of which were mentioned above, add a significant cost to the final imaged product. Therefore, a number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. More recently, U.S. Pat. No. 5,853,926 to Bohan et al. discloses a protective coating for a photographic element, involving the application of an aqueous coating comprising polymer particles and a soft polymer latex binder. The patent lists many polymers including polyurethane. This coating allows for appropriate diffusion of photographic processing solutions, and does not require a coating operation after exposure and processing. Again, however, the hydrophobic polymer particles must be fused to form a protective coating that is continuous and water-impermeable. Unfortunately, the physical integrity of this coating is not good, and the large particles tend to fall off the coating before fusing.

Protective coatings containing gelatin-grafted polyurethanes using pendant carboxylic acid groups on the polyurethanes for grafting, further in combination with polyvinyl alcohols, have been disclosed for use as overcoats on the non-emulsion side of photographic elements. See, for example, U.S. Pat. Nos. 5,910,401 and 5,846,699. U.S. Pat. No. 5,846,699 discloses a mixture of a polyurethane and a carboxylic acid containing polymer having an acid number of 60 to 260, to provide resistance to abrasion and the like, for example on the backing of a photographic element.

The ability to provide the desired property of post-process water/stain resistance of an imaged photographic element, at the point of manufacture of the photographic element, is a highly desired feature. However, in order to accomplish this feature, the desired photographic element should be permeable to aqueous solutions during the processing step, but after processing achieve water resistance and even water impermeability for at least some time after contact with water. Commonly assigned U.S. Ser. No. 09/235,436 now U.S. Pat. No. 6,077,648, discloses the use of a processing solution permeable overcoat that is composed of a urethane-vinyl copolymer having acid functionalities. Commonly assigned U.S. Ser. No. 09/235,437 and U.S. Ser. No. 09/448,213 now U.S. Pat. No. 6,194,130, disclose the use of a second polymer such as water-soluble (non-cross-linked) gelatin or polyvinyl alcohol to reduce such defects and disadvantages.

Protective coats on recording media have similar challenges. Although a developing solution for that includes an oxidizable silver halide developing agent is not involved, the recording system often involves the application of a water soluble dye or pigment to a hydrophilic recording layer in the recording medium. After the application of the color material but not before, however, it may be desirable to render the surface of the medium water resistant. For example, European Patent Application 0,858,905A1 describes a porous, particulate outermost layer applied to ink-jet recording media, that is heat-fused after ink absorption to form a protective surface. Such porous surface layers are often mechanically weak and in particular can be prone to scratching damage or material removal during transport and handling prior to image formation and subsequent fusing, thus compromising the usefulness of their protective function.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene having a melting temperature (Tm) of 55 to 200° C., and therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. The fusing step is simple and environmentally friendly to photofinishing laboratories. Since the particles are incorporated entirely within the uppermost layer, this approach does not suffer from a lack of mechanical strength and integrity during transport and handling prior to image formation and fusing. However, the scratch resistance of such an overcoat after fusing is a serious concern, since polyethylene is a very soft material.

Similarly, commonly assigned U.S. Ser. No. 09/353,939 describe the use of a polystyrene-based material, with gelatin as the binder, in an overcoat for a photographic element, which overcoat can be fused into a water resistant overcoat after photographic processing is accomplished to generate an image.

In the context of photographic development, there is apparently a limited selection of materials that can be used in the overcoat of a gelatin-based photographic product, which allows photographic image processing to be carried out for image formation and subsequently transforms into a water resistant layer by the means of heat and pressure. Therefore, there remains a need for, and it would be highly desirable to obtain, an overcoat applied to a photographic element before development that would not significantly reduce the rate of reaction of the developer with the underlying emulsions, but which would ultimately provide a water resistant and durable overcoat after the processing or developing step. There is likewise a need for an improved coating applied to a recording element, such as ink-jet media, before printing that would not significantly reduce the rate of absorption of an aqueous coloring solution into the underlying recording layers, but which would ultimately provide a water resistant and durable overcoat after the print or image is formed on the recording element. Finally, there is a need for an improved coating applied to a recording element, such as electrophotograhic media, that would provide a water-resistant coating after the usual fusing step.

SUMMARY OF THE INVENTION

The present invention provides an imaging element comprising an aqueous-coatable overcoat that can be coated on to the imaging element, which allows for appropriate diffusion of photographic processing solutions or uptake of ink or toners, and the like, and which can be fused after photographic processing or ink-jet or electrophotographic printing to form a water-resistant protective overcoat with improved scratch resistance.

More particularly, the present invention describes an uppermost-layer or overcoat composition that can be incorporated into (coating onto) the imaging element during manufacturing and that does not inhibit photographic processing or uptake of ink or toners. A component of the invention is the hydrophobic polymer particles of a water-dispersable segmented polyurethane. The material of the invention can be introduced to the overcoat coating melt in a latex form or as a conventional colloidal dispersion in gelatin. It allows photographic processing to proceed at an acceptable rate. After processing to obtain images, the imaging element can be fused at a temperature sufficiently high to form a water-resistant surface. The protective overcoat of the present invention offers improved dry scratch resistance.

In one embodiment of the invention, the overcoat composition applied to the imaging element comprises 30 to 95 weight percent, based on the dry laydown of the overcoat, of hydrophobic polymer particles having an average size of 0.01 to 0.5 micrometers, said hydrophobic polymer being a water-dispersible segmented polyurethane and 5 to 70 weight percent of gelatin, based on the dry laydown of the overcoat:

Another aspect of the invention provides for a method of forming an image in the imaging element described above and converting the overcoat into a water-resistant coating.

DETAILED DESCRIPTION OF THE INVENTION

The present invention provides an improved overcoat formulation for the imaging side of an imaging element or material, including photographic prints, which encounter frequent handling and abuse by end users. The preferred overcoat formulation of this invention comprises 30 to 95% by weight (based on the dry laydown of the overcoat) of hydrophobic polymer particles of 0.01 to 0.5 micrometers in average size and 5 to 70% by weight (based on the dry laydown of the overcoat including gelatin as the primary binder).

A water-resistant layer can be formed by fusing the imaging element at a temperature sufficiently high after the photographic material has been processed to generate an image or the ink-jet image has been formed. The presence of 5–70% by weight of gelatin is sufficient to allow proper permeability for processing solution to diffuse in and out for image development, or for ink to be received by the ink-jet receiving layer. The coating solution is aqueous and can be incorporated in the manufacturing coating operation without any equipment modification. The fusing step is simple and environmentally friendly to photofinishing laboratories.

The hydrophobic polymer of this invention are preferably water dispersible polyurethanes, preferably segmented polyurethanes. Polyurethanes are the polymerization reaction product of a mixture comprising polyol monomers and polyisocyanate monomers. A preferred segmented polyurethanes is described schematically by the following stricture (I):

Structure I

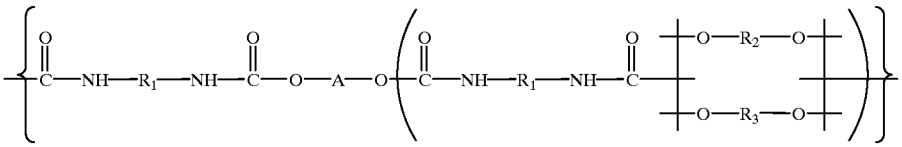

wherein $R_1$ is preferably a hydrocarbon group having a valence of two, more preferably containing a substituted or unsubstituted, cyclic or non-cyclic, aliphatic or aromatic group, most preferably represented by one or more of the following structures:

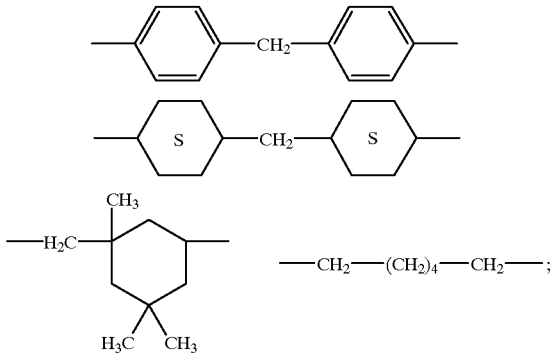

and wherein A represents a polyol, such as a) a dihydroxy polyester obtained by esterification of a dicarboxylic acid such as succinic acid, adipic acid, suberic acid, azelaic acid, sebacic acid, phthalic, isophthalic, terephthalic, tetrahydrophthalic acid, and the like, and a diol such as ethylene glycol, propylene-1,2-glycol, propylene-1,3-glycol, diethylene glycol, butane-1,4-diol, hexane-1,6-diol, octane-1,8-diol, neopentyl glycol, 2-methyl propane-1,3-diol, or the various isomeric bis-hydroxymethylcyclohexanes; b) a polylactone such as polymers of ∈-caprolactone and one of the above mentioned diols; c) a polycarbonate obtained, for example, by reacting one of the above-mentioned diols with diaryl carbonates or phosgene; or d) a polyether such as a polymer or copolymer of styrene oxide, propylene oxide, tetrahydrofuran, butylene oxide or epichlorohydrin;

$R_3$ is a phosphonate, carboxylate or sulfonate group; and.

$R_2$ is a diamine or diol having a molecular weight less than about 500. Suitable well known diamine chain extenders useful herein include ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, ethylene methylenebis(2-chloroaniline), 3,3'-dichloro-4,4'-biphenyl diamine. 2,6-diaminopyridine, 4,4'-diamino diphenylmethane, and adducts of diethylene triamine with acrylate or its hydrolyzed products. Also included are materials such as hydrazine, substituted hydrazines such as, for example, dimethyl hydrazine, 1,6-hexamethylene-bis-hydrazine, carbodihydrazide, hydrazides of dicarboxylic acids and sulfonic acids such as adipic acid mono- or dihydrazide, oxalic acid dihydrazide, isophthalic acid dihydrazide, tartaric acid dihydrazide, 1,3-phenylene disulfonic acid dihydrazide, omega-amino-caproic acid dihydrazide, hydrazides made by reacting lactones with hydrazine such as gamma-hydroxylbutyric hydrazide, bis-semicarbazide, bis-hydrazide carbonic esters of glycols such as any of the glycols mentioned above. Suitable well known diol chain extenders may be any of the glycols or diols listed above for A. $R_3$ is a phosphonate, carboxylate or sulfonate group.

The number of repeating units of structure I can range from 2 to 200, preferably 20 to 100. The amount of the hard-segment (in the right-hand parenthesis)is preferably 40 to 70 percent by weight. The weight ratio of the $OR_3O$ to the $OR_2O$ repeating unit preferably varies from 0 to 0.1.

The water-dispersible polyurethane employed in the invention may be prepared as described in "Polyurethane Handbook," Hanser Publishers, Munich Vienna, 1985.

There may be added to the overcoat a dye that will impart color or tint or dyes that impart speed control. A UV absorber may be added to make the overcoat UV absorptive, thus protecting the image from UV induced fading. Other compounds may be added to the coating composition, depending on the functions of the particular layer, including surfactants, hardeners or crosslinking agents for the gelatin, emulsifiers, coating aids, lubricants, matte particles, rheology modifiers, antifoggants, inorganic fillers such as conductive and nonconductive metal oxide particles, pigments, magnetic particles, biocides, and the like. The coating composition may optionally also include a small amount of organic solvent, preferably the concentration of organic solvent is less than 5 percent by weight of the total coating composition.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol™ OT), and alkylcarboxylate salts such as sodium decanoate.

The surface characteristics of the overcoat are in large part dependent upon the physical characteristics of the polyurethane. However, the surface characteristics of the overcoat also can be modified by the conditions under which the surface is fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may optionally be used in the coating composition of the invention, such matting agents have been described in *Research Disclosure* No. 308119, published December 1989, pages 1008 to 1009. However, the amount of matting agents should be limited so as not to interfere with proper fusing of the polyurethane particles. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the coating composition may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as camauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly(trifluorochloroethylene), poly(vinylidene fluoride, poly(trifluorochloroethylene-co-vinyl chloride), poly(meth)acrylates or poly(meth)acrylamides containing perfluoroalkyl side groups, and the like. Polyethylene particles are also useful to provide lubrication. For example, U.S. Pat. No. 5,965,304 describes polyethylene lubricants in protective overcoats. Other lubricants useful in the present invention are described in further detail in *Research Disclosure* No. 308119, published December 1989, page 1006.

The coating composition of the invention is advantageously applied simultaneously with the underlying layers of the imaging element for ease of manufacture. However, it is also possible to apply the overcoat separately by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published Dec. 1989, pages 1007 to 1008.

The laydown of the overcoat will depend on its field of application. For a photographic element, the laydown is preferably 50 to 500 mg/ft$^2$, more preferably 100 to 300 mg/ft$^2$. It may be advantageous to increase the amount of gelatin in the overcoat as the laydown increases in order to improve the developability. The higher the laydown of the hydrophobic polymer component, the better the water resistance. On the other hand, the increasing the laydown, at some point, may tend to slow down the kinetics of the photographic development.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure,* Item 36230 (June 1994). Photographic elements can be either simple black-and-white or monochrome elements or multilayer and/or multicolor elements adapted for use in a negative-positive process or a reversal process. Generally, the photographic element is prepared by coating one or both sides of the film or paper support with one or more layers comprising a dispersion of silver halide crystals in an aqueous solution of gelatin and optionally one or more subbing layers. The coating process for the various layers can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December, 1978).

Imaging elements protected in accordance with this invention can be derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such as paper prints. Because of the amount of handling that can occur with paper prints and motion picture prints, they are the preferred photographic imaging elements according to the present invention.

The photographic elements in which the images to be protected are formed can have the structures and components shown in Research Disclosure 37038 and 38957. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The element can contain additional layers, such as filter layers, interlayers, overcoat layers, subbing layers, and the like. All of these can be coated on a support which can be transparent (for example, a film support) or reflective (for example, a paper support). Support bases that can be used include both transparent bases, such as those prepared from polyethylene terephthalate, polyethylene naphthalate, cellulosics, such as cellulose acetate, cellulose diacetate, cellulose triacetate, and reflective bases such as paper, coated papers, melt-extrusion-coated paper, and laminated papers, such as those described in U.S. Pat. Nos. 5,853,965; 5,866,282; 5,874,205; 5,888,643; 5,888,681; 5,888,683; and 5,888,714. Photographic elements protected in accordance with the present invention may also include a magnetic recording material as described in *Research Disclosure,* Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of Research Disclosure 37038 (or 38957). Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), aciylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element or color paper element, the element is first treated with a black and white developer (that is, a developer which does not form colored dyes with the coupler compounds) followed by a treatment to render developable unexposed silver halide (usually chemical or light fogging), followed by treatment with a color developer. Development may be followed by bleach-fixing, to remove silver or silver halide, washing and drying.

In one embodiment of a method of using a composition according to the present invention, a photographic element may be provided with a processing-solution-permeable overcoat having the above described composition overlying the silver halide emulsion layer superposed on a support.

The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The polymer overcoat is coalesced by fusing (heat and/or pressure) after processing to form a fully water-resistant or water impermeable protective overcoat with excellent gloss characteristics. Fusing may be carried out at a temperature of from 70 to 160° C. Without wishing to be bound by theory, it is believed that fusing causes the polyurethane particles to melt and rise to the surface, forming a water-resistant continuous layer, with underlying unmelted polyurethane particles and gelatin.

The present invention also applies to image recording elements in which the images to be protected are formed in one or more recording layers, for example as produced using inkjet printing or electrophotographic printing. Ink-jet printing technology is reviewed in an article titled "Progress and Trends in Ink-Jet Printing Technology" by Hue P. Le in the Journal of Imaging Science and Technology, Volume 42, Number 1 (January/February 1998), pp. 49–61. Essentially, ink droplets, typically in the volume range 1–100 picoliters, are ejected from a printhead to a receiver material on which the image is formed. The ink-jet printhead may be of the continuous or drop-on-demand varieties. Several physical mechanisms for drop ejection are known, but the currently most popular among these are thermal and piezoelectric. In the thermal mechanism, ink in the printhead is heated to form a water vapor bubble that expels one or more ink droplets out of the printhead toward the receiver. Representative thermal ink-jet printheads are described in, for example, U.S. Pat. No. 4,723,129 of Endo et al. (Canon) and U.S. Pat No. 4,490,728 of Vaught et al. (Hewlett Packard). In the piezoelectric mechanism, one or more droplets are expelled from the printhead by a physical deformation that accompanies a voltage change across a piezoelectric material forming a part of the printhead structure. Representative piezoelectric printheads are described in, for example, U.S. Pat. No. 4,459,601 of Howkins (Exxon) and U.S. Pat. No. 5563634 of Masahiro et al. (Seiko Epson).

The carrier for the ink-jet inks may be comprised solely of water or can be predominantly water mixed with water soluble solvents such as polyhydric alcohols or can be predominantly organic materials such as polyhydric alcohols. The dyes used in such compositions are typically water-soluble direct or acid type dyes. Such liquid ink compositions have been described extensively in the prior art, including, for example, U.S. Pat. No. 4,781,758.

In addition to water and one or more colorants, such as dyes or pigments, an aqueous ink typically contains one or more humectants, which affect ink viscosity and volatility, one or more surfactants, which affect the wetting and penetrating properties of the ink, and a biocide, which extends the useful life of the ink. Aqueous inks may also contain many other ingredients, including metal ion chelating agents, pH buffers, defoamers, and dispersing agents. It is well known to improve the tone scale or bit depth of an image by using more than one ink density for each color. Representative ink-jet inks are described in, for example, U.S. Pat. No. 5,571,850 of Ma et al. (DuPont), U.S. Pat. No. 5,560,770 of Yatake (Seiko Epson), and U.S. Pat. No. 5,738,716 of Santilli et al. (Eastman Kodak).

Ink-jet media or receivers may be reflective, transparent, or of intermediate transparency (e.g., for day/night display materials). At minimum, an ink-jet receiver includes a support and an ink receiving layer. The simplest ink-jet receiver is plain paper, in which these two functions are combined. As a practical matter, more complex receiver structures are required for improved image quality and physical properties. Specifically formulated ink receiving layers coated on paper or other supports improve color density and dot resolution. Receiver composition and structure may also be modified to improve properties such as wettability, ink absorptivity, drying time, gloss, reduced image artifacts, waterfastness, and light and dark stability. Representative ink-jet receiver structures and compositions are described in, for example, U.S. Pat. No. 4,954,395 of Hasegawa et al. (Canon), U.S. Pat. No. 5,725,961 of Ozawa et al. (Seiko Epson), and U.S. Pat. No. 5,605,750 of Romano et al. (Eastman Kodak).

The use of the present invention in the context of typical recording elements will now be described in more detail. Any support or substrate may be used in a recording element, for example, plain or calendered paper, paper coated with protective polyolefin layers, polymeric films such as poly(ethylene terephthalate), poly(ethylene naphthalate), poly(1,4-cyclohexane dimethylene terephthalate), polyvinyl chloride, polyimide, polycarbonate, polystyrene, or cellulose esters. In particular, polyethylene-coated paper or poly(ethylene terephthalate) is preferred.

The support is suitably of a thickness of from about 50 to about 800 μm, preferably from about 75 to 500 μm. Therefore, on page 19 (on the original draft), the range should be 50 to 800 um, preferably 75 to 500 um.Antioxidants, antistatic agents, plasticizers, dyes, pigments and other known additives may be incorporated into the support, if desired.

In order to improve the adhesion of the image-recording layer to the support, the surface of the support may be optionally subjected to a corona-discharge treatment prior to applying the image-recording layer.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

Typically, the backing layer may comprise a binder and a filler. Typical fillers include amorphous and crystalline silicas, poly(methyl methacrylate), hollow sphere polystyrene beads, micro crystalline cellulose, zinc oxide, talc, and the like. The filler loaded in the backing layer is generally less than 5 percent by weight of the binder component and the average particle size of the filler material is in the range of 5 to 30 μm. Typical binders used in the backing layer are polymers such as acrylates, methacrylates, polystyrenes, acrylamides, poly(vinyl chloride)-poly(vinyl acetate) co-polymers, poly(vinyl alcohol), cellulose derivatives, and the like. Additionally, an antistatic agent also can be included in the backing layer to prevent static hindrance of the recording element. Particularly suitable antistatic agents arc compounds such as dodecylbenzenesulfonate sodium salt, octyl-sulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder. An image-recording layer may also be coated on the backside, if desired.

Preferably, the support in a recording element is coated with an image forming layer or layers of materials capable of absorbing the carrier and/or dyes in the the ink. The thickness of this layer is typically from 5 to 50 micrometers (μm). The material may include a hydrophilic polymer, including naturally-occurring hydrophilic colloids and gums such as gelatin, albumin, guar, xantham, acacia, chitosan, starches and their derivatives, functionalized proteins, functionalized gums and starches, and cellulose ethers and their derivatives, polyvinyloxazoline and polyvinylmethyloxazoline, polyoxides, polyethers, poly (ethylene imine), poly(acrylic acid), poly(methacrylic acid), n-vinyl amides including polyacrylamide and polyvinylpyrrolidone, and poly(vinyl alcohol), its derivatives and copolymers. Poly(vinyl alcohol) and its derivatives are preferred hydrophilic absorbing materials for use in ink receptive coatings. This layer may also comprise a microporous material. Preferred microporous materials are silica, alumina, or hydrated alumina, boehmite, mica, montmorillonite, kaolite, talc, vermiculite, zeolites, calcium silicate, titanium oxide, barium sulfate, and the like, optionally in combination with a polymeric binder. See, for example, U.S. Pat. No. 5,605,750, incorporated by reference. Many known microporous materials may be employed, including for example, those described in U.S. Pat. Nos. 5.032,450; 5,035,886, 5,071,645, and 5,14,438.

For higher quality ink-jet media, a separate upper image-forming layer may be formed above a carrier-absorbing layer. Accordingly, when the ink is ejected from the nozzle of the ink-jet printer in the form of individual droplets, the droplets pass through the upper layer where most of the dyes or pigments in the ink are retained or mordanted while the remaining dyes/pigments and the carrier portion of the ink pass freely through the upper layer to the carrier-absorbing layer where they are rapidly absorbed, for example, by a hydrophilic polymer and/or microporous material. In this manner, large volumes of ink are quickly absorbed by the recording elements, giving rise to high quality recorded images having excellent optical density and good color guamet.

Image-forming layers in recording elements can also incorporate various known additives, including matting agents such as titanium dioxide, zinc oxide, silica, and polymeric beads such as polystyrene beads for the purposes of contributing to the non-blocking characteristics of the recording elements and to control the smudge resistance thereof; surfactants for improving the aging behavior of the ink-absorbing resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; dye-fixing agents; viscosity modifiers; waterproofing agents; dispersing agents; UV absorbing agents; mordants, and the like.

If desired, in addition to a coating according to the present invention, the recording element can be further coated with an ink-permeable, anti-tack, ink receptive coating, such as, for example, a hydrophilic cellulose derivative such as methyl cellulose, ethyl cellulose, hydroxyethyl cellulose, hydroxypropyl cellulose, sodium carboxymethyl cellulose, calcium carboxymethyl cellulose, methyethyl cellulose, methylhydroxyethyl cellulose, hydroxypropylmethyl cellulose, hydroxybutylmethyl cellulose, ethylhydroxyethyl cellulose, sodium carboxymethylhydroxyethyl cellulose, carboxymethylethyl cellulose, hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethylammonium chloride and esters of hydroxyethyl cellulose and a lauryldimethylammonium substituted epoxide; as well as hydroxyethyl cellulose grafted with alkyl C12–C14 chains.

The present invention is illustrated by the following Examples.

EXAMPLES

Characterizations of polymeric materials in the following examples were obtained by the following tests or analytical techniques:

Glass Transition Temperature and Melting Temperature

Both glass transition temperature (Tg) and melting temperature (Tm) of the dry polymer material were determined by differential scanning calorimetry (DSC), using a ramping rate of 20 C/minute. Tg is defined herein as the inflection point of the glass transition and Tm is defined herein as the peak of the melting transition.

Particle Size Measurement

All particles were characterized by Photon Correlation Spectroscopy using a Zetasizer™ Model DTS5100 manufactured by Malvern Instruments.

Average Molecular Weight

The samples were analyzed by size-exclusion chromatography in tetrahydrofuran using three Polymer Laboratories Plgel™Mixed-C columns. The column set was calibrated with narrow-molecular-weight distribution polystyrene standards between 595 (log M=2.76) and 2170000 (log M=6.34) daltons. Number average molecular weight and polydispersity (defined as the ratio of weight average molecular weight and number average molecular weight) were reported.

Preparation of polymeric materials in the following examples were obtained by the following synthetic methods.

C1 (Comparative Polymer)

This material is a high density polyethylene in the aqueous dispersion form, purchased from SC Johnson under the trade name Jonwax™ 26. The number average molecular weight of polyethylene is 7100. The average particle size of dispersion is 50 nm and Tm is 130° C. The aqueous dispersion was dialyzed against distilled water for 16 hours using membrane with molecular weight cutoff of 20,000 to remove excess surfactants and salts.

P1 (Polymer of the Invention)

In a 1 liter resin flask equipped with thermometer, stirrer, water condenser and a vacuum outlet was melted and dewatered 8.60 g (0.01 mole) polycarbonate polyol KM101733 (Mw=860) under vacuum at 100 C. The vacuum was released and at 40 C was added 2.55 g (0.019 mole) dimethylol propionic acid, 27.8 g (0.125 mole) isophorone diisocyanate, and 5 drops dibutyltin dilaurate (catalyst) while stirring. The temperature was adjusted to 75 C and maintained for about 4 hours to complete the reaction resulting in an intermediate containing approximately 3% NCO. Subsequently, 50 g N-methyl pyrrolidone was stirred in, with continued stirring at the same temperature for about 1 hour, after which 8.65 g (0.096 mole) 1,4-butane diol was stirred in and the temperature maintained until NCO is substantially nil. A stoichiometric amount of potassium hydroxide was stirred in based on dimethylol propionic acid, and maintained for 5 min. An amount of water about 5 times the amount of N-methyl pyrrolidone was mixed under high shear to form a stable aqueous dispersion.

P2 (Polymer of the Invention)

P2 is prepared the same a polymer P1 except dimethylol propionic acid is neutralized with triethylamine prior to dispersion.

P3 (Polymer of the Invention)

In a 1 liter resin flask equipped as in P1 is placed 294.0 g (0.28 mole) of dry polypropylene glycol (Mw=1000), 40.20 g (0.30mole) dimethylol propionic acid, 278 g (1.25 mole) isophorone diisocyanate, 800 g ethyl acetate, and 0.03% by weight dibutyltin dilaurate (catalyst) with stirring. The temperature was adjusted to 75 C and maintained for about 12 hours. To the resulting intermediate was added 225.3 g (0.67mole) bisphenol AF slurred in 200 g ethyl acetate, and the temperature was maintained until substantially devoid of NCO. A stoichiometric amount of potassium hydroxide was added based on dimethylol propionic acid and dispersed in water as in P1 above.

P4 (Polymer of the Invention)

P4 is prepared the same a polymer P3 except dimethylol propionic acid is neutralized with triethylamine prior to dispersion in water.

P5 (Polymer of the Invention)

The procedure of P1 is repeated with the following modifications: 11.62 g (0.014 mole) Polycaprolactone (Mw=830) is used as the polyol, 11.5 g (0.11 mole) neopentyl glycol is the chain extender.

P6 (Polymer of the Invention)

The procedure of P1 is repeated with the following modifications: 100 g (0.033mole) Polycaprolactone (Mw=3000) is used as the polyol, 32.8 g (0.125mole) 4,4'-methylene bis(cyclohexylisocyanate) as the diisocyanate, 1.58 g (0.013 mole) melamine, and 11.86 g (0.038 mole) Bisphenol A hydroxyethyl either as mixed chain extenders P7 (Polymer of the Invention)

The procedure of P1 is repeated with the following modifications: 22.7 g (0.041 mole) Polycaprolactone Mw=530 is used as the polyol, 40.43 g (0.16 mole) 4,4'-diphenylmethane diisocyanate, 7.5 g (0.07 mole) neopentyl glycol are used as the isocyanate and chain extender respectively.

P8 (Polymer of the Invention)

The procedure of P1 is repeated with the following modifications: 20.3 g (0.021 mole) Poly(tetramethylene glycol) Mw=1000 is used as the polyol, tetrahydrofuran is the reaction solvent, and the dimethylol propionic acid component is neutralized with triethylamine prior to dispersion in water.

P9 (Polymer of the Invention)

The procedure of P1 is repeated with the following modifications: 36 g (0.018 mole) Poly(ethylene adipate) glycol Mw=2000 is used as the polyol, tetrahydrofuran is the reaction solvent, 11.04 g (0.106 mole) neopentyl glycol is the chain extender, and the acid component is neutralized with triethyl amine prior to dispersion in water.

P10 (Polymer of the Invention)

Into a 1 liter resin flask equipped as in P1 is placed 393.75 g (0.38mole) of dry polypropylene glycol (Mw=1000), 342.45 g (1.5 mole) bisphenol A, 1.875 g ethyl acetate, and 0.03% by weight dibutyltin dilaurate (catalyst) with stirring. The temperature was adjusted to 60 C and maintained until bisphenol A is completely dissolved. To the resultant solution was added 417 g (1.875 mole) isophorone diisocyanate in 375 g of ethyl acetate. The temperature was adjusted to 80 C and maintained until NCO is nil. This polyurethane was subsequently dispersed in water by one of the two procedures described below. However, variations and modifications known in the art of dispersion may also be employed.

Dispersion of Polyurethane:

(A) To 100 g of the above polymer at 40% solids was added 12.11 g of 3% by weight of sodium dioctyl sulfosuccinate (Aerosol OT). To this was added 403.6 g of a 10% gelatin solution and 1200 g of water under high shear for approximately 10 minutes. Ethyl acetate was removed by evaporation under reduced pressure. The particle size range is from 0.05 to 0.30 micrometers in diameter.

(B) Polymer solid (40 grams) was dissolved in 160 grams of ethyl acetate, and then emulsified in a 45° C. aqueous solution containing 180 g of water, 80 g of 12.5% gelatin solution and 40 g of 10% Alkanol XC solution by passing the mixture through a colloid mill with 4–5 mil gap for 4 times. Ethyl acetate was removed by heating the emulsified dispersion under low pressure. The particle size of dispersed particles were generally from 0.10 to 0.25 micrometers in average diameter.

Photographic Sample Preparation:

Sample 1.1 was prepared by coating in sequence a blue-light sensitive layer, an interlayer, a green-light sensitive layer, a UV layer, a red-light sensitive layer, a UV layer and an overcoat on photographic paper support. The components in each individual layer is described below. Other samples were prepared identically to sample No. 1.1 except for different overcoat compositions.

| Layer | Laydown (mg/sq.ft.) | |
|---|---|---|
| Overcoat | 40.0 | Gelatin |
| | 1.0 | SF-1 |
| | 0.39 | SF-2 |
| | 8.87 | Bis(vinylsulfonyl)methane |
| UV | 12.11 | UV-1 |
| | 2.13 | UV-2 |
| | 6.25 | ST-4 |
| | 2.37 | Di-butyl phthalate |
| | 2.37 | 1,4-Cyclohexylenedimethylene bis(2-ethylhexanoate) |
| | 47.7 | Gelatin |
| Cyan | 16.2 | Red-light sensitive AgX |
| | 39.31 | C-1 |
| | 38.52 | di-butyl phthalate |
| | 3.22 | Tri-cresyl phosphate |
| | 25.31 | UV-1 |
| | 126.6 | Gelatin |
| | 0.5 | Silver phenyl mercaptotetrazole |
| UV | 17.43 | UV-1 |
| | 3.07 | UV-1 |
| | 9.00 | ST-4 |
| | 3.41 | Di-butyl phthalate |
| | 3.41 | 1,4-Cyclohexylenedimethylene bis(2-ethylhexanoate) |
| | 68.6 | Gelatin |
| Magenta | 7.70 | Green-light sensitive AgX |
| | 1.11 | Potassium chloride |
| | 29.5 | M-1 |
| | 8.26 | Di-butyl phthalate |
| | 3.54 | S-4 |
| | 17.7 | ST-1 |
| | 2.01 | ST-2 |
| | 57.0 | ST-3 |
| | 0.05 | 1-Phenyl-5-mercaptotetrazole |
| | 0.285 | Nitric acid |
| | 117 | Gelatin |
| Interlayer | 10.0 | ST-4 |
| | 17.38 | Di-butyl phthalate |
| | 6.0 | Disulfocatechol disodium |
| | 0.524 | Nitric acid |
| | 0.18 | SF-1 |
| | 70.0 | Gelatin |
| Yellow | 25.0 | Blue-light sensitive AgX |

-continued

| Layer | Laydown (mg/sq.ft.) | |
|---|---|---|
| | 60.0 | Y-1 |
| | 26.3 | S-4 |
| | 0.88 | ST-16 |
| | 0.23 | Dye-4 |
| | 0.012 | 1-Phenyl-5-mercaptotetrazole |
| | 124.1 | Gelatin |

| Photographic paper support: | |
|---|---|
| Sublayer 1: | resin coat (Titanox and optical brightener in polyethylene) |
| Sublayer 2: | paper |
| Sublayer 3: | resin coat (polyethylene) |

C-1

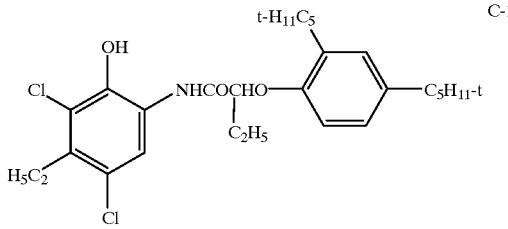

M-1

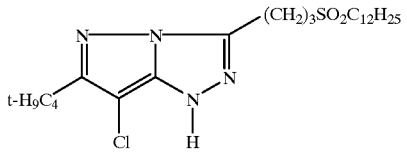

Y-1

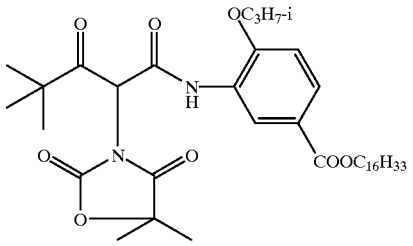

ST-16

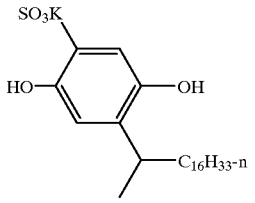

ST-1

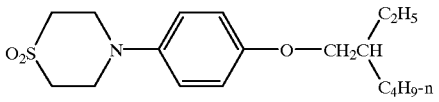

ST-2

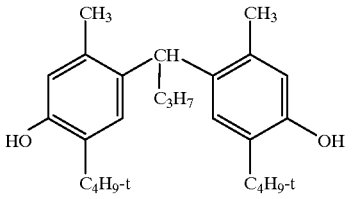

-continued

Photographic paper support:

ST-3

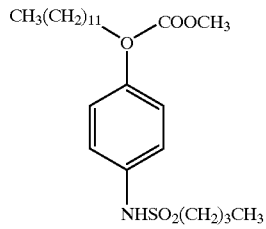

ST-4

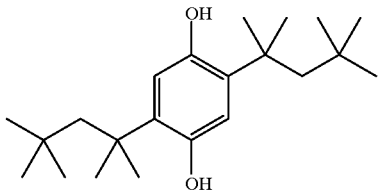

ST-21

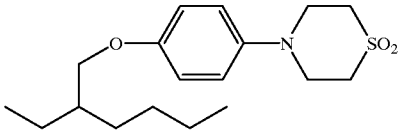

ST-22

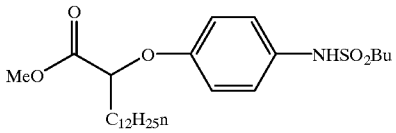

UV-1

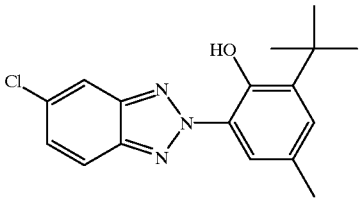

UV-2

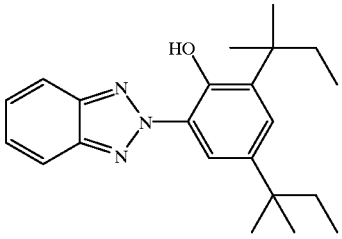

SF-1

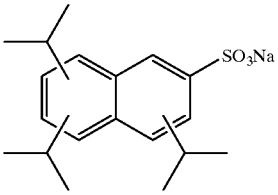

SF-2

$CF_3.(CF_2)_7.SO_3Na$

S-4 = Diundecyl phthalate

S-6 = Tris(2-ethylhexyl)phosphate

-continued

Photographic paper support:

DYE-4

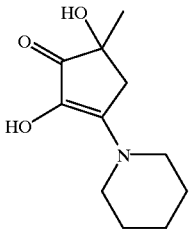

Testing Photographic Samples

The Testing of the Photographic Samples were conducted as follows:

Test for Water Resistance:

Ponceau Red dye is known to stain gelatin through the ionic interaction, and therefore is used here to test for water resistance. Ponceau red dye solution was prepared by dissolving 1 gram dye in 1000 grams mixture of acetic acid and water (5 parts: 95 parts). The water permeability was done by soaking fused samples in the dye solution for 5 minutes, followed by a 30-second water rinse to removed excess dye solution on the coating surface. Each sample was then air dried, and status A reflectance green density on the soaked area was recorded. A high optical density of 3 is an indication of a completely water permeable coating, such as sample No. 1. Its water resistance=0%. Relative to density of 3 (sample No. 1) being 0% water resistance and density of 0 being 100% water resistant, the percent water resistance is calculated by the following equation.

$$\%\ \text{water resistance}=[1-(\text{status A density}/3)]\times 100$$

Lowest Fusing Temperature:

Samples without being exposed to light were processed through the Kodak RA4 process to obtain white Dmin samples. These processed samples were then passed through a set of heated pressurized rollers (fusing) at various temperatures. These samples were then tested by Ponceau Red dye solution as described above to determine water resistance. The lowest fusing temperature is reported for which samples turned into water impermeable when fused at or above such temperature.

Test for Dry Scratch Resistance:

Each sample was rubbed with a dry paper towel for 8 passes under 5 a pressure of 0.75 psi (500 grams over a 1.375-inch diameter area). The scratches generated by the rubbing test were observed and reported.

Example 1

The following samples were prepared and tested for fusibility, water resistance before and after fusing, and dry scratch resistance.

TABLE 1

| Sample ID | Overcoat Composition (in mg/sq. ft.) | Comparison/ Invention | % water resistance prior to fusing | Lowest Fusing Temperature (° F.) | % water resistance after fusing |
|---|---|---|---|---|---|
| 1.1 | 40 gelatin | Comparison | 0% | N/A | 0% |

TABLE 1-continued

| Sample ID | Overcoat Composition (in mg/sq. ft.) | Comparison/ Invention | % water resistance prior to fusing | Lowest Fusing Temperature (° F.) | % water resistance after fusing |
|---|---|---|---|---|---|
| 1.2 | 40 gelatin + 160 Jonwax ™ 26 | Comparison | 0% | 300 | 96% |
| 1.3 | 40 gelatin + 130 Jonwax ™ 26 | Comparison | 0% | 300 | 96% |
| 1.4 | 40 gelatin + 160 P1 | Invention | 0% | 310 | 95% |
| 1.5 | 40 gelatin + 160 P2 | Invention | 0% | 320 | 94% |
| 1.6 | 40 gelatin + 160 P3 | Invention | 0% | 320 | 95% |
| 1.7 | 40 gelatin + 160 P4 | Invention | 0% | 320 | 96% |
| 1.8 | 40 gelatin + 160 P5 | Invention | 0% | 330 | 91% |
| 1.9 | 40 gelatin + 160 P6 | Invention | 0% | 330 | 94% |
| 1.10 | 40 gelatin + 160 P7 | Invention | 0% | 340 | 92% |
| 1.11 | 40 gelatin + 160 P8 | Invention | 0% | 320 | 96% |
| 1.12 | 40 gelatin + 160 P9 | Invention | 0% | 300 | 93% |
| 1.13 | 40 gelatin + 160 P10 | Invention | 0% | 310 | 96% |

For comparison, Sample 1.1 did not contain any fusible polymer in the overcoat and therefore did not exhibit any water resistance after being fused. Samples 1.2 through 1.15 showed 0% water resistance prior to fusing, which indicates processing solutions are free to diffuse through the overcoat layer of this invention to generate images. Samples 1.2 and 1.3 contained high density polyethylene particles in the overcoat, as described in U.S. Pat. No. 5,856,051, and showed water resistance after being fused, but inferior scratch resistance regardless of the amount of Jonwax 26 polyethylene particles. Samples 1.4 through 1.15 contained particles of this invention in the overcoat. Samples 1.4 through 1.15 exhibited water resistance and improved dry scratch resistance after being fused, compared to samples 1.2 and 1.3.

Example 2

This Example illustrates that an overcoat according to this invention is able to provide developability for imaging layers before fusing and water resistance after fusing, with acceptable dry scratch resistance. As a check for comparison, a conventional colored photographic element, Sample 2.1, was prepared as follows:

Blue Sensitive Emulsion (Blue EM-1).

A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazolc)-pentachloroiridate, a small amount of KI solution, and shelling without any dopant. The resultant emulsion contains cubic shaped grains having edge length of 0.6 $\mu$m. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1):

A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3 $\mu$m in edgelength size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1):

A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 micrometers in edgelength size. The emulsion is optimally sensitized by the addition of glutaryldiaminophenyldisulfide, sodium thiosulfate, tripotassium bis{2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known in the art. The following imaging layers were coated in sequence on polyethylene-laminated photographic paper.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |

-continued

| | | |
|---|---|---|
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one(3/1) | o.o1 9 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | S-4 | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | S-4 | 10.40 |
| | ST-21 | 3.698 |
| | ST-22 | 26.39 |
| | Dye-2 | 0.678 |
| | 5-chloro-2-methyl-4-isothiazolin-3-one/2-methyl-4-isothiazolin-3-one(3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | S-4 | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methyl-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | S-6 | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | S-6 | 7.404 |
| | 5-chloro-2-methyl-4-isothiazolin-3-one/2-methyl-4-isothiazolin-3-one(3/1) | 0.009 |
| Layer 7 | SOC | |
| | Gelatin | 59.98 |
| | Ludox AM ™ (colloidal silica) | 14.99 |
| | Polydimethylsiloxane (DC200 ™) | 1.877 |
| | 5-chloro-2-methyl-4-isothiazolin-3-one/2-methyl-4-isothiazolin-3-one(3/1) | 0.009 |
| | SF-2 | 0.297 |
| | Tergitol 15-S-5 ™ (surfactant) | 0.186 |
| | SF-1 | 0.753 |

-continued
| | |
|---|---|
| Aerosol OT ™ (surfactant) | 0.269 |
IC-35
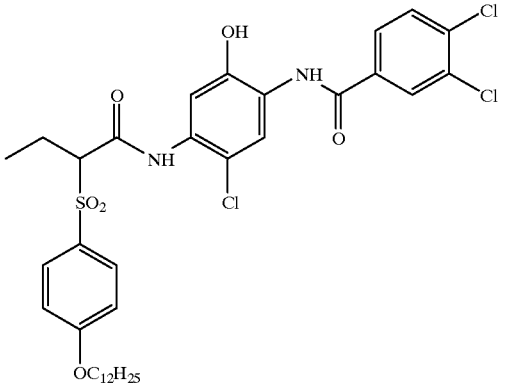
IC-36
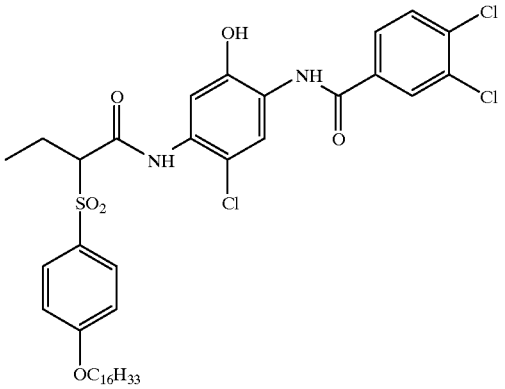
M-4
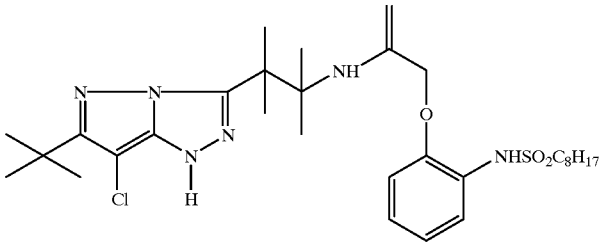
Y-4
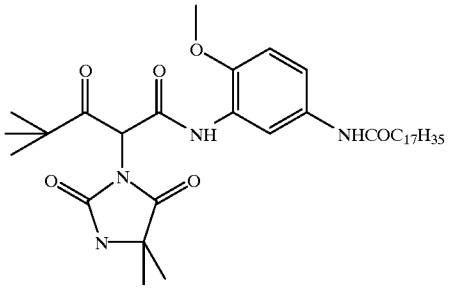

-continued
ST-16
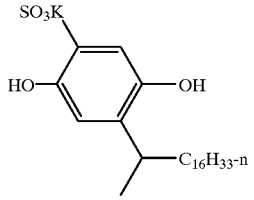
ST-4
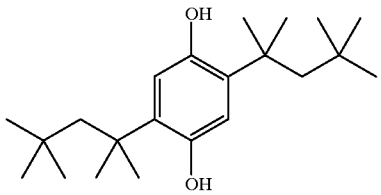
ST-21
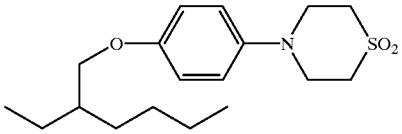
ST-22
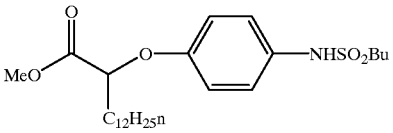
ST-23
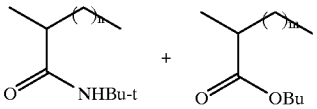
n:m = 1:1; MW = 75,000–100,000
ST-24
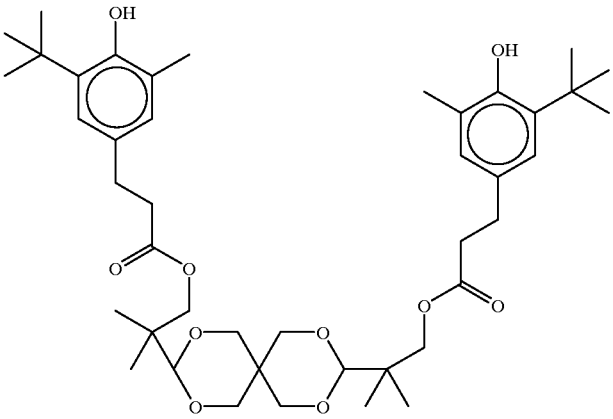
UV-1
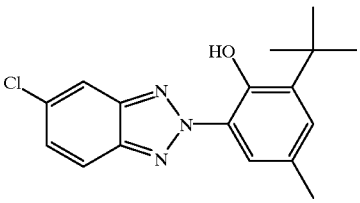

-continued
UV-2
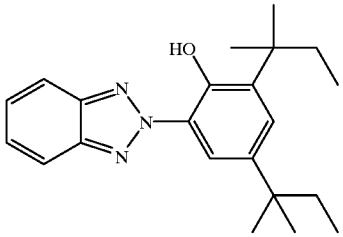
SF-1
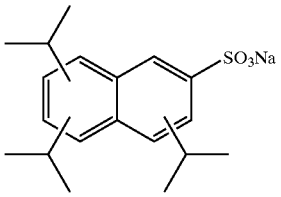
SF-2
$CF_3.(CF_3)_7.SO_3Na$
S-4 = Diundecyl phthalate
S-6 = Tris(2-ethylhexyl)phosphate
BSD-4
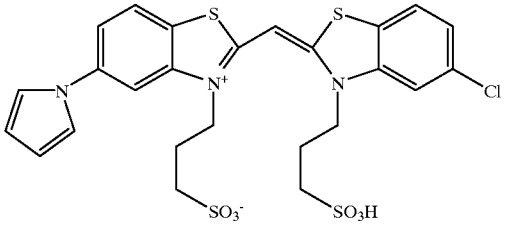
GSD-1
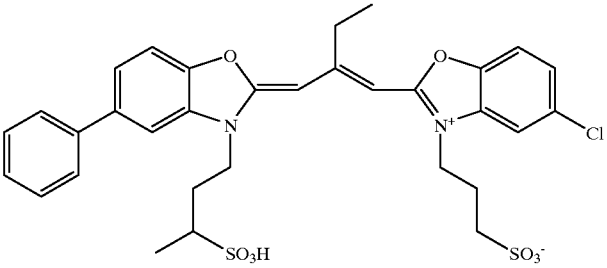
RSD-1
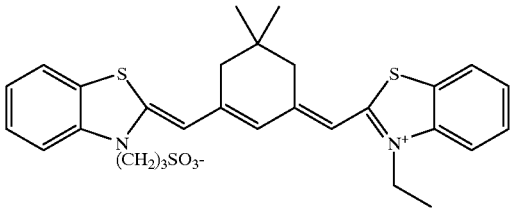
DYE-1
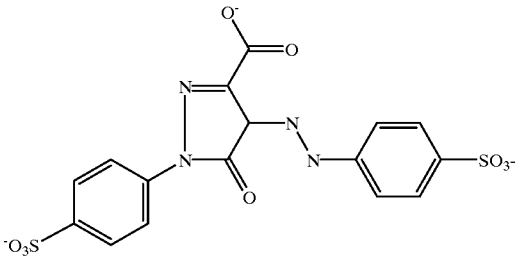

-continued

DYE-2

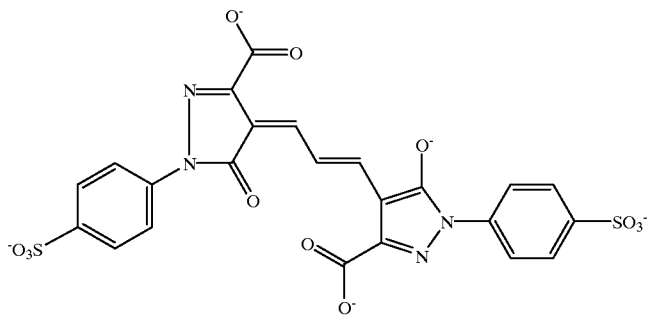

DYE-3

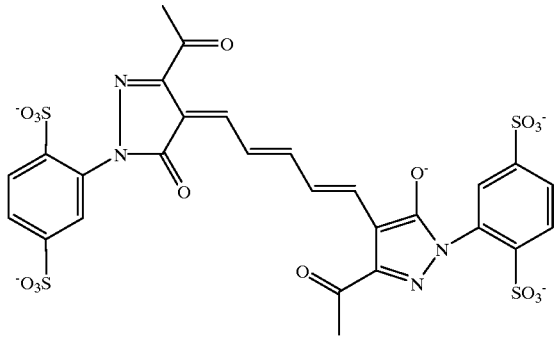

Sample 2.2 according to this invention was prepared identically to Sample 2.1 except by replacing 60 mg/sq.ft. of gelatin with 40 mg/sq.ft. gelatin and 160 mg/sq.ft. of P4 in the overcoat. Both samples were tested for fusibility, water resistance before and after fusing, and scratch resistance. The results are shown in Table 2 below.

TABLE 2

| Sample ID | Overcoat Composition (in mg/sq.ft.) | Invention or Comparison | % water resistance prior to fusing | Lowest Fusing Temperature (° F.) | % water resistance after fusing |
|---|---|---|---|---|---|
| 2.1 | 60 gel | Comparison | 0% | | 0% |
| 2.2 | 40 gel + 160 P4 | Invention | 0% | 320 | 96% |

As shown in Table 2 above, the overcoat of this invention is able to provide developability for imaging layers before fusing and improved water resistance after fusing, with acceptable dry scratch resistance, equivalent to Sample 1.7 in Example 1. Thus, the advantages of the overcoat can be obtained regardless of changes in imaging layers.

Example 3

In this Example, the photographic element tested, Comparative Sample 3.1, is the same as Comparative Sample 2.1, except that the support is a biaxially oriented support consisting of a paper base and a biaxially oriented polypropylene sheet laminated to both sides of the paper base. Sample 3.2 is identical to Sample 3.1, except for replacement of 60 mg/sq.ft. of gelatin with 40 mg/sq.ft. of gelatin and 160 mg/sq.ft. of P4 in the overcoat. The corresponding fusibility, water resistance before and after fusing, are shown in Table 3.

TABLE 3

| Sample ID | Overcoat Composition (in mg/sq.ft.) | Inventions or Comparison | % water resistance prior to fusing | Lowest Fusing Temperature (° F.) | % water resistance after fusing |
|---|---|---|---|---|---|
| 3.1 | 60 gel | Comparison | 0% | | 0% |
| 3.2 | 40 gel + 160 P4 | Invention | 0% | 320 | 96% |

As shown in Table 3, the overcoat of this invention is able to provide developability for imaging layers before fusing and water resistance after fusing, with acceptable dry scratch resistance as in Examples 1 and 2, regardless of changes in imaging layers and the paper support.

Example 4

This example illustrates the use of an overcoat according to the present invention on ink-jet media. The improved overcoat consists of 200 mg/sq.ft. of gelatin and 600 mg/sq.ft. of P4 in the overcoat. For ink-jet receiver materials, the overcoat of this invention is able to provide for passage of ink into the ink-receiving layer before fusing and water resistance after fusing, with acceptable dry scratch resistance.

The invention has been described in detail with particular reference to certain preferred embodiments thereof, but it will be understood that variations and modifications can be effected within the spirit and scope of the invention.

What is claimed is:

1. A method of making a photographic element having a developed image comprising:

providing a photographic element comprising a support, at least one silver halide emulsion layer superposed on a side of said support, an overcoat comprising comprising 30 to 95 weight percent of hydrophobic polytirethane particles having an average size of 0.01 to 0.5 micrometers and 5 to 70 weight percent of gelatin, wherein weight percent is based on the dry laydown of the overcoat:

imagewise exposing the photographic element to light;

developing the photographic element in a photoprocessing solution;

and fusing the overcoat to render it water-resistant.

2. The method of claim 1 further comprising fusing the overcoat by the application of heat at a temperature of 70 to 160° C.

3. The method of claim 1 wherein the fusing comprises the application of both heat and pressure.

4. The method of claim 1 wherein the manufacture of the photographic element comprises the application of at least one silver-based light sensitive emulsion layer simultaneously with the overcoat composition.

5. A method of making a recording element having a formed image comprising:

providing a recording element comprising a support, at least one ink or toner receiving layer and, overlying the receiving layer, an overcoat comprising 30 to 95 weight percent of the overcoat, of hydrophobic polyurethane particles having an average size of 0.01 to 0.5 micrometers and 5 to 70 weight percent of gelatin, wherein weight percent is based on the dry laydown of the overcoat:

forming an image on the receiving layer using an ink-jet or electrophotographic process to form an imaged element.

fusing the overcoat under heat, thereby coalescing the hydrophobic particles to form a substantially continuous water-resistant coating.

6. The method of claim 5 wherein the fusing comprises the application of heat and pressure.

7. A recording medium comprising:

(a) a support;

(b) at least one receiving layer for absorbing a color forming ink or for receiving toner particles; and (c) an overcoat, overlying the receiving layer, comprising 30 to 95 weight percent of hydrophobic polyurethane particles having an average size of 0.01 to 0.5 micrometers and 5 to 70 weight percent of gelatin, wherein weight percent is based on the dry laydown of the overcoat.

8. The recording medium of claim 7 wherein component (b) comprises a hydrophilic polymer.

9. The recording medium of claim 7 wherein component (b) comprises a microporous material.

10. The recording medium of claim 7 for use in ink-jet printing further comprising at least one separate layer for retaining most of the carrier liquid for the ink.

* * * * *